United States Patent [19]

Tomaro

[11] 4,210,797

[45] Jul. 1, 1980

[54] FOLDABLE CURLING IRON PROVIDING FOR SELF-STORAGE AND SAFETY DISCONNECTION

[75] Inventor: Patrick M. Tomaro, Maplewood, N.J.

[73] Assignee: Conair Corporation, Edison, N.J.

[21] Appl. No.: 848,471

[22] Filed: Nov. 4, 1977

[51] Int. Cl.[2] ..... H05B 3/06; A45D 1/04; A45D 2/24; H01H 3/16

[52] U.S. Cl. ..... 219/225; 30/155; 132/37 R; 200/61.58 R; 200/61.7; 219/227; 219/230; 219/240; 219/533; 362/199

[58] Field of Search ..... 219/222–225, 219/230, 242, 533, 240; 417/411; 362/199, 183; 361/344; 200/61.7, 61.85, 61.58 R; 132/31 R, 32 R, 37, 37 A, 9, 11 R, 143–145, 150, 37 R; 30/140, 153, 155, 161

[56] References Cited

U.S. PATENT DOCUMENTS

| | | | |
|---|---|---|---|
| 1,549,776 | 8/1925 | Laufe | 219/225 X |
| 2,066,328 | 1/1937 | Cameron | 219/240 X |
| 2,118,997 | 5/1938 | Zook | 362/199 |
| 2,794,085 | 5/1957 | De Angelis | 200/61.7 X |
| 2,930,857 | 3/1960 | Hollingsworth | 200/61.58 X |
| 3,016,432 | 1/1962 | Bassani | 361/344 X |
| 3,586,820 | 6/1971 | Yamamaka | 219/242 X |
| 3,714,411 | 1/1973 | Waters et al. | 362/183 X |
| 3,788,777 | 1/1974 | Fichter | 417/411 |
| 4,075,458 | 2/1978 | Moyer | 219/533 X |
| 4,101,757 | 7/1978 | Van Dyck et al. | 219/225 |

FOREIGN PATENT DOCUMENTS 1375768 11/1974 United Kingdom ..... 219/225

*Primary Examiner*—A. Bartis

*Attorney, Agent, or Firm*—Haynes N. Johnson; Mark P. Stone

[57] ABSTRACT

A curling iron includes a tubular barrel extending forwardly from a hollow handle. The barrel contains an electric heating element and is provided with a spring-biased pivotable hair holding clamp conforming to the surface of the barrel. The barrel and clamp are pivotal as a unit about 180 degrees from the extended operative position into a folded storage position within the handle through a side opening in the handle. The opening is closed by a pair of inwardly pivotable doors which are spring-biased to an outward closed position conforming to the outer surface of the handle. Pivotal movement of the barrel from its extended position causes contacts on the barrel to separate from spring contact elements fixed in the handle to disconnect the heating element from its electric power source. As the barrel and clamp are folded into the handle through the opening, the doors are pushed inwardly out of the way so that the handle may receive the barrel and clamp for storage. When the barrel is in the extended, operative position, an abutment member on the drum presses against the inner surface of the handle doors, thereby firmly retaining those doors in their outward, closed position.

13 Claims, 8 Drawing Figures

Fig. 5.
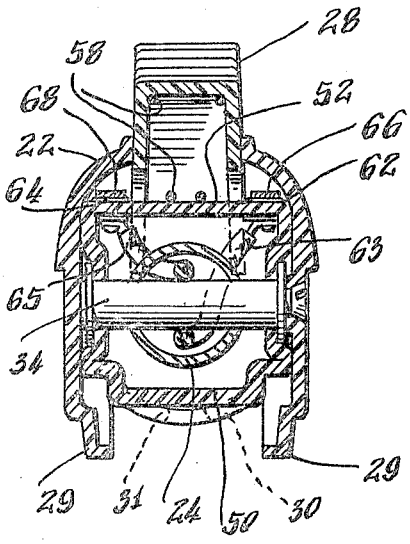
Fig. 4.
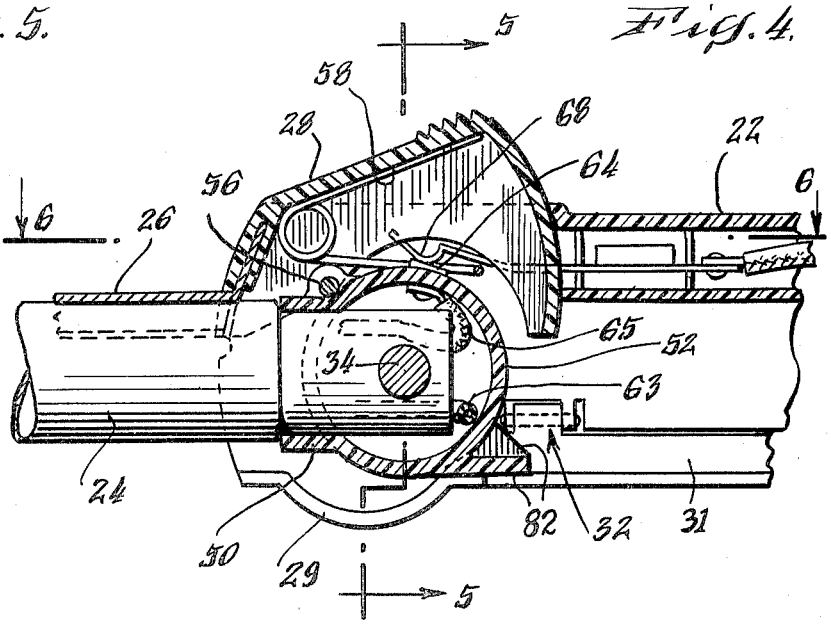
Fig. 6.
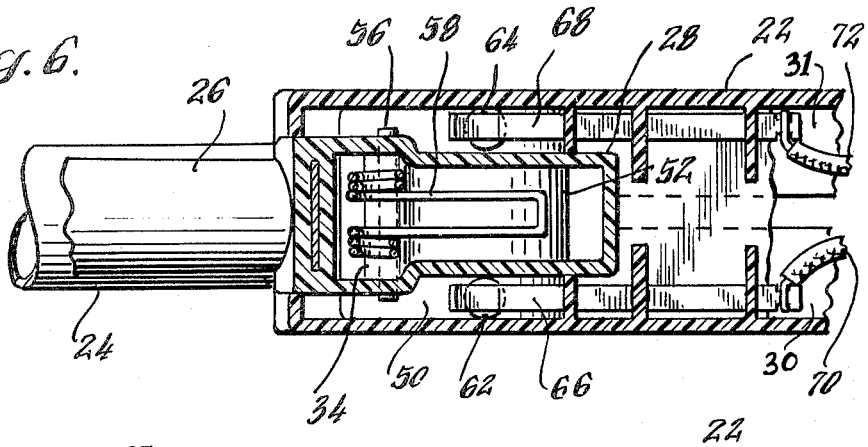
Fig. 7.
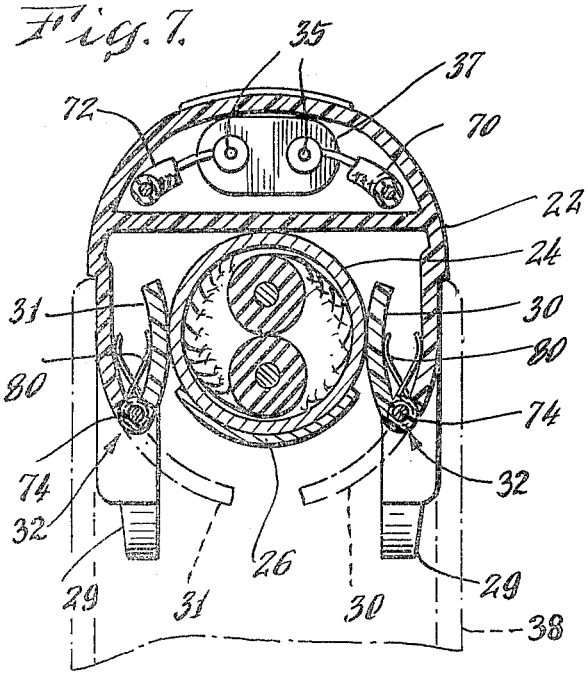
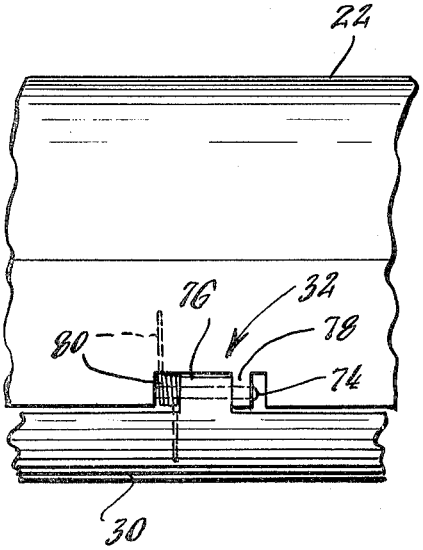
Fig. 8.

FOLDABLE CURLING IRON PROVIDING FOR SELF-STORAGE AND SAFETY DISCONNECTION

BACKGROUND OF THE INVENTION

This invention relates to electric curling irons and more particularly to electric curling irons suitable for compact storage.

A number of curling irons having electric heating elements are presently available for personal use. These curling irons generally include a tubular barrel extending from a handle and an electric heating element within the barrel. A hair-holding clamp extends along most of the length of the tubular barrel and is pressed against the barrel by a spring mechanism. Generally, the clamping finger may be pivoted away from the barrel by a lever on the handle. These curling irons take up considerable storage space and are bulky to pack when traveling.

SUMMARY

This invention provides an electrically heated curling iron which may be folded into itself to protect the fragile barrel and hair clamp and to provide a more compact package for storage.

The curling irons of this invention include the usual handle, attached heated barrel, and a pivoted spring-pressed hair-holding clamp. They have the additional features, however, of being foldable; the barrel and clamp pivot about one end of the handle, about 180 degrees, and fold into an opening in the handle. A protective cover may then be placed over the opening.

The wall of the handle includes two doors pivotal inwardly with respect to the handle. The doors are spring biased into an outward closed position but are forced inward by the tubular barrel and clamp as they are pivoted into their folded position.

According to other aspects of the invention, the electric heating elements in the tubular barrel are electrically disconnected from an electric source as the barrel is moved from its extended position. The electric connection is through at least one first electrical contact element mounted on a drum pivotal with the barrel and at least one second electrical contact element fixed relative to the handle, whereby pivoting of the barrel causes the first contact to move away from the second contact.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

FIG. 4 is a partial sectional view from the side, showing the curling iron in its open position, and taken along lines 4—4 in FIG. 2; it shows details of the pivoting means for folding and of the self-disconnecting electrical connections;

FIG. 5 is a sectional view of the curling iron from the end, taken along lines 5—5 in FIG. 4; it shows further details of the electrical connections and of the means for holding the handle doors closed;

FIG. 6 is a sectional view of the curling iron from above, taken along lines 6—6 in FIG. 4; it shows the spring and pivot for the hair-holding clamp;

FIG. 7 is a sectional view of the folded curling iron taken along lines 7—7 in FIG. 3; it shows how the barrel of the iron fits within the handle;

FIG. 8 is a partial side view of a door hinged to the handle of the curling iron as in FIG. 1.

DESCRIPTION OF A PREFERRED EMBODIMENT

Figure 1:
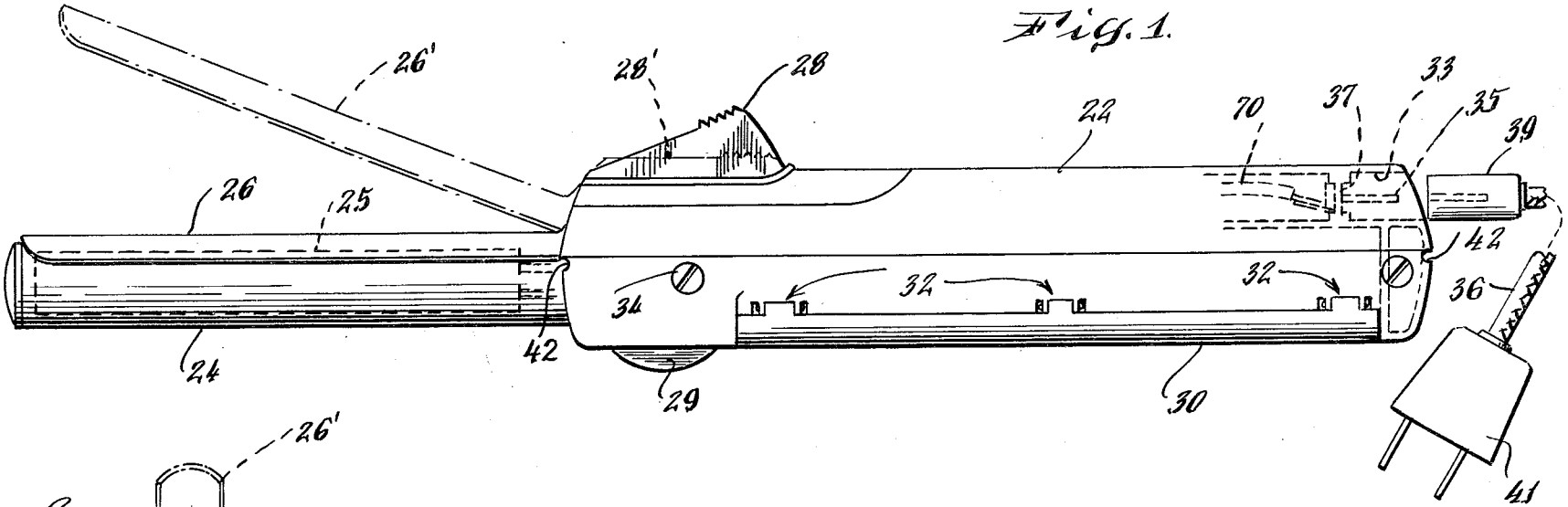
FIG. 1 is a side view of an electrically heated curling iron including a tubular barrel extending from a handle and a pivotal clamp extending along the tubular barrel.
Figure 2:
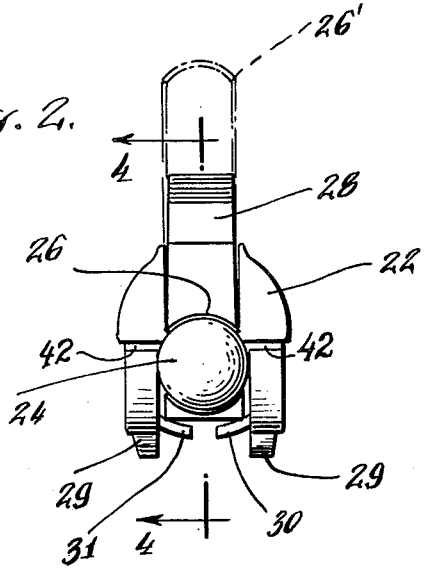
FIG. 2 is an end view of the curling iron of FIG. 1.

An electrically heated curling iron having the appearance of a conventional curling iron is shown in FIG. 1. The curler includes a generally tubular handle 22, preferrably of hard plastic material. A tubular metal barrel 24 extends from one end of the handle 22 and houses an electrical heating element 25 in FIG. 1. A hair-holding clamp 26 extends along most of the length of barrel 24 and, as best shown in FIG. 2, has a transverse shape conforming to the external contour of the tubular barrel 24. A clamp-actuating lever 28 extends from the clamp 26 at an angle substantially less than 180 degrees. The clamp 26 and lever 28 are pivotal about a pivot pin 56 (FIG. 4) extending transverse to the tubular barrel. Thus, when lever 28 is pressed to the position indicated by the broken lines at 28' the clamp pivots away from the tubular barrel 24 to the position shown at 26'. When the lever 28 is released a clamp biasing means, including a spring mechanism within the handle to be described subsequently, biases the clamping finger 26 against the tubular barrel.

Feet 29 extend below the handle 22 near the barrel 24. They are so positioned that the center of gravity of the unit is to their right in FIG. 1. Consequently, when the curling iron is set down on a table or the like, the hot barrel does not contact the table.

The electrically heated curling iron thus far described may be used in the conventional manner including clamping hair between the hair-holding clamp 26 and the electrically heated barrel 24.

Figure 3:
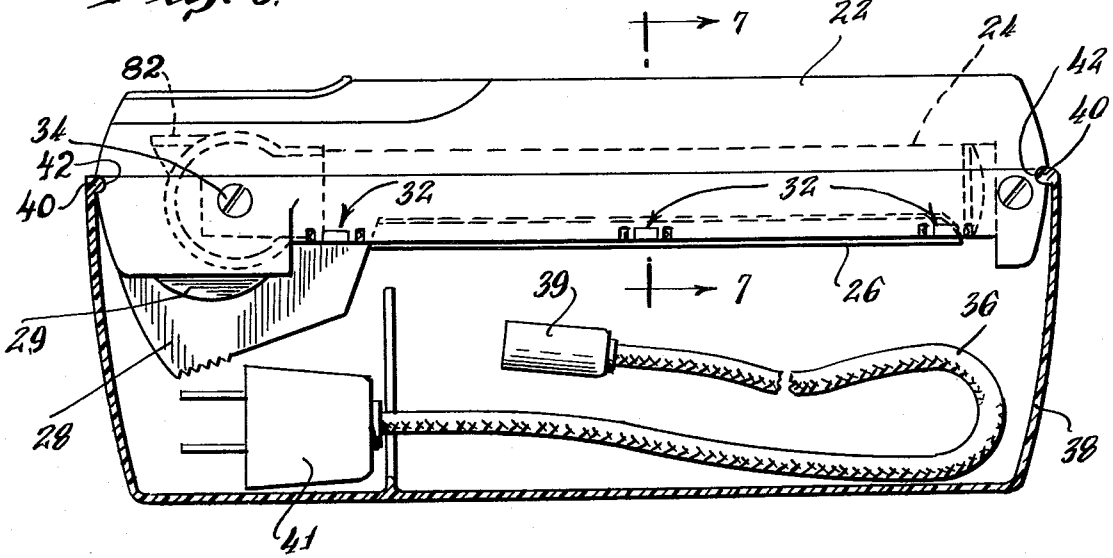
FIG. 3 is a side view of the electrical curling iron of FIG. 1 in its folded position and further includes in section a suitable cord container secured to the bottom of the handle.

Referring to FIGS. 1 and 2, the tubular barrel 24 and clamp 26 are pivotal together about a pivot pin 34 extending through the handle transverse to the tubular barrel. The barrel and clamp may be pivoted about this pivot through a pivot angle of about 180 degrees from the extended position shown in FIG. 1 to a folded position within the handle 22 as shown in FIG. 3.

The lower wall of the handle comprises two doors 30 and 31 which may pivot inwardly into the handle 22 about hinges 32 to provide an opening in the bottom wall along most of the handle length. During use of the curler, these doors are biased outwardly by springs to conform with and partially form the outer surface of handle 22. As will be more readily understood with later reference to FIG. 7, in the folded position the barrel 24 forces the doors 30 and 31 inwardly with respect to the handle. As can be seen in FIG. 1, the barrel 24 is somewhat shorter than the handle 22 and, as shown in FIG. 7, the barrel is also somewhat narrower than the handle. With the doors 30 and 31 in their open position, an opening which is wider than and longer than the barrel 24 is provided in the bottom wall of the handle. Hence, the opening is so positioned and of sufficient size to receive the barrel when the barrel is pivoted into the folded position.

With the barrel and clamp folded into the handle, the total length of the curling iron is reduced to that of the handle. Also, the barrel is almost completely enclosed within the handle, thereby protecting it.

As shown in FIG. 1, electrical connecting pins 35 are positioned within a cavity 33 in the end of the handle 22. The pins extend from an insulator plate 37, the back side of which is shown in FIG. 7. To provide an electrical connection through the handle, a plug 39 on the end of an electrical cord 36 is inserted into the cavity 33 and receives the pins 35 in a conventional fashion. The other end of the cord is provided with a plug 41 to be inserted into a household electrical outlet when the curling iron is in use.

To complete the curling iron package, the electrical cord 36 of the curling iron is disconnected from the handle, coiled, and placed in a container 38 as shown in FIG. 3. The folded curling iron is then pressed into the top of the container 38 with lever 28 extending into the container. As the folded curling iron is forced into the container 38, the container ends flex outwardly to permit inwardly directed lips 40 to engage peripheral grooves 42 at each end of the handle of the curling iron, thereby locking the folded iron into the container. The handle is thus adapted to serve as a closure to the container 38. The curling iron can be removed from the container 38 by grasping the handle and the container and pulling them apart. The lower surface of the groove acts as a cam to force the container ends outwardly.

The pivot mechanisms of the curling iron of FIG. 1 through 3 can best be seen in the sectional views of FIG. 4 through 6. The tubular barrel 24 extends into and is fixed to a drum 50 which includes a curved surface 52 centered about the pivot pin 34. The pivot pin 34 extends from one side of the handle to the other through both the drum 50 and the barrel 24. Although shown as a discrete element, the pin may simply be molded, inward extensions from the handle sides joined by a concentric screw. In that case the screw may secure two molded plastic sections forming the handle.

In either case, the drum 50 and barrel 24 slidably rotate about the pivot pin 34. Due to a close fit between the drum and barrel and the pin, frictional forces resist rotation of the drum and barrel; hence, once placed in either the extended or folded position, the barrel remains in that position until sufficient force is applied thereto to overcome the frictional forces.

A clamp supporting pin 56 is fixed to the drum 50 and supports the clamp lever 28 as best shown in FIG. 6. A coiled spring 58 is positioned between the lever 28 and the drum 50. Upper arms of the spring 58 press against the inner surface of the lever 28 and a lower U-shaped arm of the spring presses against the drum 50. The lever arm 28 is thereby biased away from the drum 50 and, due to its pivotal support on pin 56, the clamp 26 is biased toward the barrel 24. Because the clamp and clamp lever are supported on the drum 50 and because the clamp lever 28 is spring biased away from the drum 50, the clamp remains pressed against the tubular barrel 24 even as the barrel rotates about pivot pin 34 with the drum 50. Thus, once the barrel 24 has pivoted through an angle of 180 degrees, the clamp lever 28 points downward as shown in FIG. 3.

The electrical heating element in the barrel 24 can only be connected to an electrical source only when the tubular barrel is in its extended position, since power for the heating element must pass through an electrical connector which disconnects when the iron is folded or partially folded. The electrical connector includes electrical contact elements 62 and 64 mounted to the outer surface 52 of drum 50, the drum being of electrically insulating material. Electrical wires 63 and 65 extend from the respective contacts through barrel 24 to the electrical heating element 25 within barrel 24. A second set of electrical contact elements, leaf spring contacts 66 and 68 (FIGS. 4 and 6), are fixed to the handle 22. Electrical wires 70 and 72 extend from the spring contacts 66 and 68 through pins 35 and the cord 36 to the household electrical source.

The leaf spring contacts 66 and 68 press against the drum surface 52 and, when the barrel is in its extended position, make contact with contact elements 62 and 64 as shown. However, because the contacts 62 and 64 are displaced from the pivot pin 34 as the barrel pivots from its extended position, these contact elements move about the pivot pin away from the leaf spring contact elements to disconnect the heating element from its power source. Leaf springs 66 and 68 then ride around the surface 52 of drum 50. By means of the electrical connector described, there is no danger of the electrical heating element being operable when the curling iron is in its folded position.

Each door 30 and 31 is pivotal inwardly about three hinges 32 (FIG. 3), one of which is shown in FIG. 8. Each hinge includes a pin 74 extending through door and handle extensions 76 and 78. A spring 80 is coiled around the pin 74 and presses against the inner walls of both the handle 22 and the door 30 to bias the door outwardly to conform with the handle outer surface. However, when the barrel 24 and clamp 26 are pivoted back to the folded position, the barrel forces doors 30 and 31 inwardly thereby opening the doors and permitting the barrel and clamp to move into the hollow handle. Doors 30 and 31 act somewhat like "bomb bay" doors and, as shown in FIG. 7, are held open by the barel 24 so long as the barrel is in its folded position.

As shown in FIG. 4, a door abutment member 82 extends from the center of the drum surface 52 and, when the barrel 24 is in its extended position, the abutment member presses against the inner surfaces of doors 30 and 31, thereby firmly retaining the doors in their outward closed position.

From the above, it is apparent that the curling iron is initially packaged as shown in FIG. 3 with the cord 36 disconnected and coiled in the container 38. The person wishing to use the curler simply grasps the handle 22 and the container 38 and pulls them apart. The barrel 24 of the thus removed curling iron is than grasped and pulled outward from its position within the handle. The doors 30 and 31 automatically close since they are biased outward by springs 80. The barrel is then pivoted further to the extended position. Although the barrel is readily pivoted to the extended position, the frictional force between the barrel 24 and drum 50 and the pivot pin 34 is sufficient to hold the barrel in its extended position once placed there. Further, with the barrel in the extended position, the doors 30 and 31 are retained in their closed position by the door abutment member 82. Finally, the cord 36 is removed from the container 38 and the respective plugs 39 and 41 are inserted into the handle cavity 33 and a household electrical outlet to ready the curling iron for use. However, if the cord 36 were connected to the iron and electrical outlet before unfolding of the curling iron, there would be no danger of heater element 25 becoming hot because with the contact elements 62 and 64 out of contact with contact elements 66 and 68, the heating element would still be disconnected from its source.

After the curling iron has been used cord 36 can be disconnected and the barrel 24 should be allowed to cool. Then the barrel can be pivoted into its closed position within the handle. Finally, the iron is packaged by coiling the cord 36 into the container 38 and by pressing the folded curling iron into its locked position shown in FIG. 3.

Thus an electrically heated curling iron has been disclosed which provides for the folding of the heater barrel into the curling iron handle to provide a compact package and also to protect the fragile barrel. Further, means has been provided to automatically close doors in the handle when the barrel has been moved to its extended position. Finally, accidental heating of the electrical heating element while the curling iron is in its folded position is precluded.

While the invention has been particularly shown and described with reference to a preferred embodiment thereof, it will be understood by those skilled in the art that various changes in form and details may be made therein without departing from the spirit and scope of the invention, as defined by the appended claims.

I claim:

1. An electrically heated curling iron comprising:

a tubular barrel having an electric heating element therein;

a hollow handle;

barrel pivot means for pivotally mounting said tubular barrel to said handle, said barrel being pivotal through a pivot angle from an operative position extending forwardly of said handle to a folded storage position within said handle through an opening in a side of said handle, a clamp extending along most of said tubular barrel and having a transverse shape conforming to the external contour of said tubular barrel, clamp pivot means for pivotally mounting said clamp to said tubular barrel, clamp biasing means for biasing said clamp against said tubular barrel throughout said pivot angle of said tubular barrel, electrical connector means in said handle for connecting said electrical heating element in said tubular barrel to an electric source when said tubular barrel is in its extended position, and two doors closing said opening and pivotal inwardly through said opening in the side of said handle and into said handle, but spring biased outwardly to conform with the handle outer surface when said tubular barrel is in its extended position, said tubular barrel forcing said doors inwardly when in its folded storage position within said handle, whereby an electrically heated curling iron which is foldable into a compact form is provided.

2. The electrically heated curling iron of claim 1 further comprising a door abutting member extending from said tubular barrel and pressing against the inner surfaces of said doors when said barrel is in its extended operative position, whereby said doors are firmly retained in their outward closed position when said barrel is in its extended operative position.

3. The electrically heated curling iron of claim 1 wherein said electrical connector means connects said electrical element to said electric source only when said tubular barrel is in its extended position, said electrical connector means comprising:

a first electrical contact element fixed relative to said tubular barrel but displaced from the barrel pivot, said first electrical contact being pivotal with said barrel, means electrically connecting said first contact element to said heating element in said tubular barrel, a second electrical contact element fixed relative to said handle and in electrical contact with said first electrical contact element when said tubular barrel is in its extended position and out of contact with said first electrical contact element when said tubular barrel is in its folded storage position, and means for connecting said second electrical contact element to said electric source, whereby said first electrical contact element moves about said barrel pivot away from said second electrical contact as said tubular barrel pivots from its extended operative position to its folded storage position.

4. The electrically heated curling iron of claim 3 wherein said first electrical contact element is mounted to a drum centered about said barrel pivot and said second electrical contact element is a spring contact biased against said drum.

5. The electrically heated curling iron of claim 1 further including an open container for removably receiving said curling iron therein through the container opening when said barrel is folded in said handle in its storage position, and locking means on said handle cooperating with complementary locking means on said container adjacent said container opening for locking together said handle and said container whereby said handle is adapted to serve as a closure for said container opening when said handle is received therein.

6. An electrically heated curling iron comprising:

a tubular barrel having an electric heating element therein;

a hollow handle, a wall of said handle comprising an opening closed by two doors pivotal inwardly with respect to said handle but spring biased outwardly to conform with the handle outer surface;

barrel pivot means for pivotally mounting said tubular barrel to said handle, said tubular barrel being pivotal through a pivot angle from an extended operative position extending forwardly of said handle to a folded storage position within said handle, said tubular barrel forcing said doors inwardly when in its folded position within said handle;

a clamp extending along most of said tubular barrel and having a transverse shape conforming to the external contour of said tubular barrel;

clamp pivot means for pivotally mounting said clamp to said tubular barrel;

clamp biasing means for biasing said clamp against said tubular barrel throughout said pivot angle of said tubular barrel;

electrical connector means in said handle for connecting said electric heating element in said tubular barrel to an electric source only when said tubular barrel is in its extended position, said electrical connector means comprising:

a first electrical contact element mounted to a drum fixed relative to said tubular barrel and pivotal with said barrel, means electrically connecting said first electrical contact element to said heating element in said tubular barrel, a second electrical contact element mounted on said handle and including a spring contact biased against said drum and in electrical contact with said first electrical contact element only when said tubular element is in its extended position, and means for connecting said second electrical contact element to said electrical source;

a door abutting member extending from said drum and pressing against the inner surfaces of said doors when said barrel is in its extended position, whereby said doors are firmly retained in their outward closed position when said barrel is in its extended position;

an open container for removably receiving said curling iron therein through the container opening when said barrel is folded within said handle in said storage position, and locking means on said handle cooperating with complementary locking means on said container adjacent said container opening for locking together said handle and said container whereby said handle is adapted to serve as a closure for said container opening when said handle is received therein.

7. A foldable curling iron adapted for safe, compact storage, said curling iron including:

a tubular barrel for receiving hair to be curled, said tubular barrel having an electric heating element therein;

a handle pivotally connected at one end thereof to one end of said barrel, said handle being hollow and having an opening in one side thereof so positioned and of sufficient size to receive said barrel when pivoted;

said barrel being pivotally movable between a first operative position extending forwardly from said handle and a second storage position wherein said barrel is received within said handle through said opening;

said handle including two doors closing said opening and pivotal inwardly through said opening into said handle but spring biased outwardly to conform with the handle outer surface when said tubular barrel is in its extended operative position, said tubular barrel forcing said doors inwardly when said tubular barrel is pivoted into said storage position within said handle;

means extending through at least a portion of said handle for supplying electric power to said heating element;

said means including an electrical connector having separable complementary portions in said handle, said separable complementary portions including a first portion fixed in said handle and a second portion mounted to said barrel and pivotal therewith, said separable complementary portions being so arranged and so positioned as to be in engagement to complete an electrical circuit to said electric heating element when said barrel is extended from said handle in said operative position and to be disengaged to break said circuit when said barrel is pivoted into said handle for storage, whereby a foldable curling iron is provided which is operative when said barrel extends from said handle and is inoperative and compact when said barrel has been folded into said handle.

8. The electrically heated curling iron of claim 7 further comprising a door abutting member extending from said tubular barrel and pressing against the inner surfaces of said doors when said barrel is in its extended operative position, whereby said doors are firmly retained in their outward closed position when said barrel is in its extended operative position.

9. The foldable curling iron of claim 7 further including:

an open container for removably receiving said curling iron therein through the container opening when said barrel is folded within said handle in said storage position, and locking means on said handle cooperating with complementary locking means on said container adjacent said container opening for locking together said handle and said container whereby said handle is adapted to serve as a closure for said container opening when said handle is received therein.

10. A foldable curling iron adapted for safe, compact storage, said curling iron including:

a tubular barrel for receiving hair to be curled, said tubular barrel having an electric heating element therein, a handle pivotally connected at one end thereof to one end of said barrel, said handle being hollow and having an opening in one side thereof, said opening being so positioned and of sufficient size to receive said barrel when pivoted, said barrel being pivotally movable between a first operative position extending forwardly from said handle and a second storge position wherein said barrel is received within said handle through said opening, said handle including two doors closing said opening and pivotal inwardly through said opening into said handle but spring biased outwardly to conform with the handle outer surface when said tubular barrel is in its extended operative position, said tubular barrel forcing said doors inwardly when said tubular barrel is pivoted into said storage position within said handle, an electrical switch having separable complementary electrical contact elements, including a first contact element mounted to and pivotal with said barrel and a second electrical contact element mounted in said handle, said first and second electrical contact elements being so arranged and so positioned to be in engagement when said barrel is extended from said handle in said operative position and to be disengaged when said barrel is pivoted into said handle for storage, said electrical switch including first means for electrically connecting said first electrical contact element to said electric heating element, and second means for electrically connecting said second electrical contact element to an electric power source so that said electric heating element is electrically actuated only when said electrical contact elements are in engagement to complete an electrical circuit between said electric heating element and said electric power source so that said electric heating element is electrically actuated only when said tubular barrel is in its extended operative position.

11. In a foldable curling iron of the type adapted for safe, compact storage including:

a tubular barrel for receiving hair to be curled, said tubular barrel having an electric heating element therein;

a handle pivotally connected at one end thereof to one end of said barrel, said handle being hollow and having an opening in one side thereof, said opening being so positioned and of sufficient size to receive said barrel when pivoted;

said barrel being pivotally movable between a first operative position extending forwardly from said handle and a second storage position wherein said barrel is received within said handle through said opening; and means for supplying electrical energy to said electric heating element when said barrel is in its extended operative position;

the improvement comprising:

said handle including two doors closing said opening and pivotal inwardly through said opening into said handle but spring biased outwardly to conform with the handle outer surface when said tubular barrel is in its extended operative position, said tubular barrel forcing said doors inwardly when said tubular barrel is pivoted into said storage position within said handle through said opening on said handle.

12. A foldable curling iron adapted for safe, compact storage, said curling iron including:

a tubular barrel for receiving hair to be curled, said tubular barrel having an electric heating element therein;

a handle pivotally connected at one end thereof to one end of said barrel, said handle being hollow and having an opening in one side thereof, said opening being so positioned and of sufficient size to receive said barrel when pivoted;

said barrel being pivotally movable between a first operative position extending forwardly from said handle and a second storage position wherein said barrel is received within said handle through said opening;

means for providing electrical power to said heating element when said tubular barrel is in its extended operative position, said means for providing electrical power including an electric power cord, one end of which is removably connected to an electric power source, the other end of which is electrically coupled through said curling iron to said heating element in said barrel when said barrel is in its extended operative position, a hollow open container having a closed bottom and an opening on its top for removably receiving said curling iron therein through the container opening when said barrel is folded within said handle in said storage position, locking means on said handle cooperating with complementary locking means on said container adjacent said container opening for locking together said handle and said container whereby said handle is adapted to serve as a closure for said container opening when said handle is received therein;

said opened container being so dimensioned relative to said curling iron in said folded position as to define a hollow compartment between the closed bottom of the container and the curling iron when the curling iron is in its folded position and received in said container opening on the top of said container;

said hollow compartment being of sufficient dimension to receive and store said electric power cord therein when said electric power cord is disconnected from said electric power source;

whereby said container provides a storage space for said folded curling iron and said electric power cord when said electric power cord is not in use.

13. In a foldable curling iron including:

a tubular barrel for receiving hair to be curled, said tubular barrel having an electric heating element therein;

a handle pivotally connected at one end thereof to one end of said barrel, said handle being hollow and having an opening in one side thereof, said opening being so positioned and of sufficient size to receive said barrel when pivoted;

said barrel being pivotally movable between a first operative position extending forwardly from said handle and a second storage position wherein said barrel is received within said handle through said opening; and means for providing electrical power to said heating element when said tubular barrel is in its extended operative position, said means for providing electrical power including a detachable electric power cord removably connected at one end to a source of electrical power and at its other end removably received within the curling iron for supplying electrical power to said curling iron for heating said heating element;

the improvement comprising:

a hollow open container having a closed bottom and an opening on its top for removably receiving said curling iron therein through the container opening when said barrel is folded within said handle in said storage position, locking means on said handle cooperating with complementary locking means on said container adjacent said container opening for locking together said handle and said container whereby said handle is adapted to serve as a closure for said container opening when said handle is received therein;

said opened container being so dimensioned relative to said curling iron in said folded storage position as to define a hollow compartment between the closed bottom of the container and the curling iron when the curling iron is in its folded position and received in said container opening on the top of said container;

said hollow compartment being of sufficient dimension to receive and store said electric power cord therein when said electric power cord is disconnected from said curling iron and said electric power source;

whereby said container provides a storage space for said folded curling iron and said electric power cord when said electric power cord is not in use.

* * * * *